United States Patent [19]

Joffre

[11] 4,184,224

[45] Jan. 22, 1980

[54] DEVICES FOR CLEANING, DUSTING, MOPPING AND APPLYING LIQUID TO FLOORS

[76] Inventor: Robert L. Joffre, 530 Parks Dr., Norton, Ohio 44203

[21] Appl. No.: 908,123

[22] Filed: May 22, 1978

[51] Int. Cl.[2] ..... A47L 13/256; A47L 13/46

[52] U.S. Cl. ..... 15/228; 15/143 R; 15/231

[58] Field of Search ..... 15/114, 115, 98, 99, 15/147 R, 147 A, 228, 229 AP, 231–233, 143; 51/392, 393; 401/18, 22–27

[56] References Cited

U.S. PATENT DOCUMENTS

| | | | |
|---|---|---|---|
| 977,701 | 12/1910 | Broberg | 15/52 |
| 1,282,361 | 10/1918 | Baker | 15/114 X |
| 1,886,852 | 11/1932 | Truda et al. | 15/232 X |
| 2,261,411 | 11/1941 | Rees | 15/231 X |
| 2,429,626 | 10/1947 | Horn | 15/231 X |
| 2,452,744 | 11/1948 | Gardner | 15/228 X |
| 2,690,582 | 10/1954 | Sundell | 15/228 |
| 2,810,149 | 10/1957 | Guelker | 15/231 |
| 2,811,734 | 11/1957 | Mee | 15/231 |
| 2,828,501 | 4/1958 | Brown | 15/231 X |

FOREIGN PATENT DOCUMENTS

| | | | |
|---|---|---|---|
| 586998 | 10/1933 | Fed. Rep. of Germany | 15/114 |
| 946865 | 12/1948 | France | 15/231 |

*Primary Examiner*—Philip R. Coe

*Attorney, Agent, or Firm*—Isler and Ornstein

[57] ABSTRACT

Devices are described which are adapted for cleaning, dusting, mopping and applying liquids or fluids to floors, more particularly bowling lanes and areas adjacent such lanes. In some of the devices, means are provided for adjusting the length or width of the devices, as well as for adjustably securing handles to the devices and for providing universal movement of the handles relatively to the devices. Means are also provided for attaching cloths to the devices, and for securing the cloths to the devices. Means are also provided for actuating the devices in such a manner as to exert added pressure to the devices and prevent tilting of the devices while in use. Additional features include means for utilizing cloths of different widths for areas of different widths or dimensions. In one of the devices, a combination of features is provided whereby the gutters of adjacent bowling lanes and the caps or areas between such adjacent lanes may be simultaneously cleaned or dusted or otherwise treated.

5 Claims, 21 Drawing Figures

DEVICES FOR CLEANING, DUSTING, MOPPING AND APPLYING LIQUID TO FLOORS

In my U.S. Pat. Nos. 3,932,043 and 4,070,726, I have disclosed various devices for cleaning, dusting, mopping and applying fluids to floors, such, for example, as bowling lanes and the like.

The present invention is concerned with improvements in such devices, and particularly to improvements which render the devices especially useful in connection with bowling lanes and areas adjacent such lanes.

A primary object of the invention is to provide devices of the character described having novel means for attaching cleaning and dusting cloths and the like to the devices.

Another object of the invention is to provide devices of the character described having novel means for attaching handles thereto.

A further object of the invention is to provide devices of the character described having actuating means or handles so designed and so connected to the devices as to exert added pressure thereto, and prevent tilting of the devices while in use.

A further object of the invention is to provide devices of the character described having novel means for lengthening the devices or adjusting the length thereof, for cleaning and dusting areas of different widths.

A still further object of the invention is to provide a device of the character described which is especially adapted for simultaneously cleaning and dusting the gutters of adjacent bowling lanes and the cap or area between such gutters.

Other objects and advantages of my invention will be apparent during the course of the following description.

In the accompanying drawings forming a part of this specification, and in which like numerals are employed to designate like parts throughout the same, FIG. 1 is a top plan view of a device embodying the invention, with portions broken away to show underlying structure;

Figure 1:
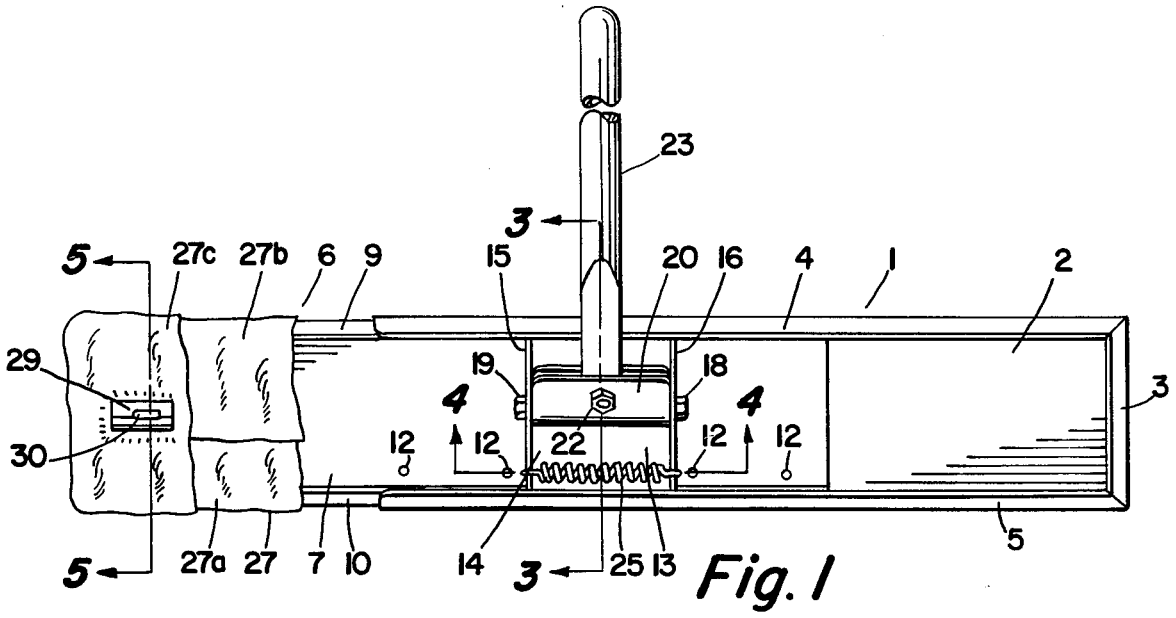

Referring more particularly to FIGS. 1, 2, 3, 4 and 5 of the drawings, reference numeral 1 designates a tray-like member having a flat base 2, a flange 3 at one end extending inwardly at an angle to the base 2, and flanges 4 and 5 at the sides thereof extending inwardly at an angle to the base 2.

A tray-like member 6 is provided, which is telescopically slidable in the tray 1, and comprises a flat base 7, a flange 8 at one end extending inwardly at an angle to the base 7, and flanges 9 and 10 at the sides thereof extending inwardly at an angle to the base 7.

Figure 3:
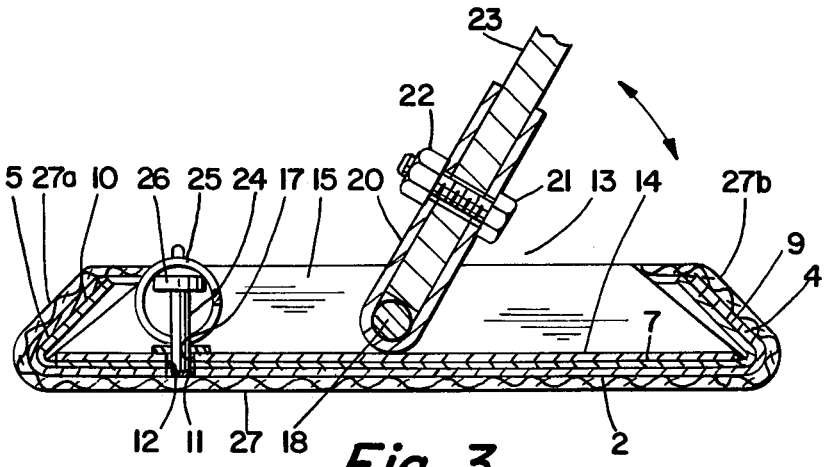
FIG. 3 is a fragmentary cross-sectional view, on an enlarged scale, taken on the line 3—3 of FIG. 1.
Figure 4:
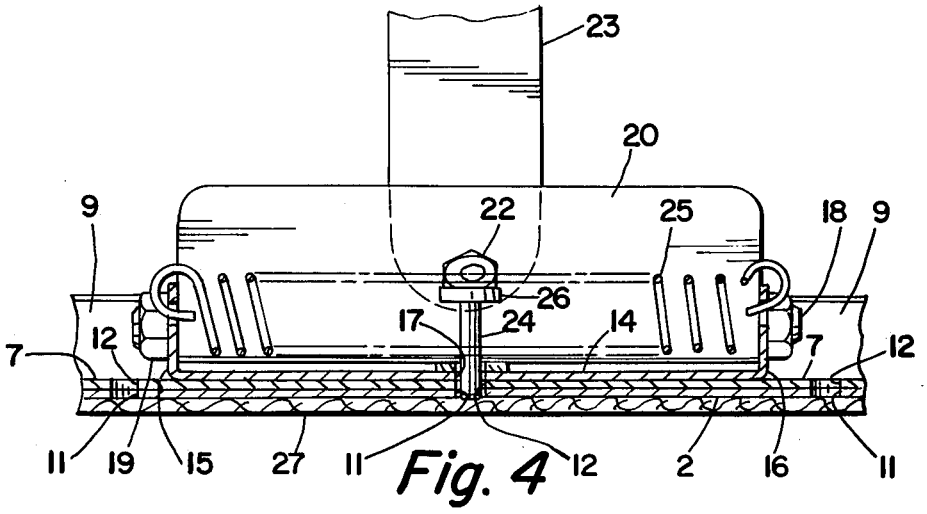
FIG. 4 is a fragmentary cross-sectional view, taken on the line 4—4 of FIG. 1.

As best seen in FIGS. 1, 3 and 4, the base 2 of the member 1 is provided adjacent the flange 5 with a row of longitudinally-spaced holes 11, while the base 7 of the member 6 is provided adjacent the flange 10 with a row of similarly spaced holes 12.

The function of the holes 11 and 12 will presently be explained.

Loosely mounted on the base 7 of the member 6 is a bracket, generally designated by reference numeral 13, and comprising a flat base 14 and spaced flanges 15 and 16, the ends of which underlie the flanges 9 and 10.

The base 14 is provided with a hole 17, which serves a purpose to be presently described.

Secured to the flanges 15 and 16, by means of a bolt 18 and nut 19, is a handle-receiving member 20, of U-shaped cross-section, which has secured thereto, as by means of a bolt 21 and nut 22, a handle 23.

The member 20, as indicated in FIG. 3, is pivotally connected to the bolt 18, so that the handle 23 has a pivotal movement relatively to the tray-like members 1 and 6, and in the directions indicated by the arrows in FIG. 3.

Figure 2:
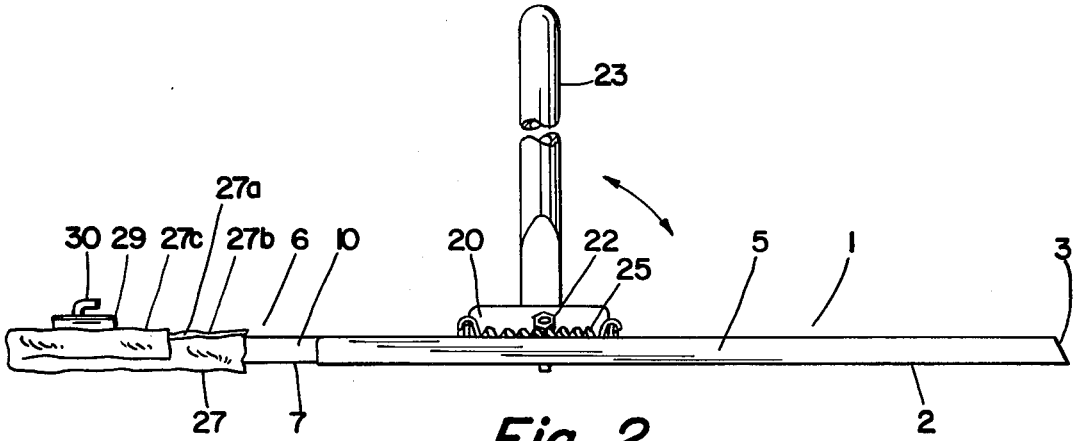
FIG. 2 is a front elevation of the device of FIG. 1, as viewed from the lower edge of FIG. 1.

At the same time, the handle 23 has a pivotal movement about the bolt 21, relatively to the tray-like members 1 and 6, and in the directions indicated by the arrows in FIG. 2.

The handle thus has a universal joint connection to the cleaning device.

As best seen in FIGS. 3 and 4, a lock-pin 24 is provided, which extends into the hole 17 and mating holes 11 and 12, for the purpose of maintaining the tray-like members 1 and 6 against longitudinal movement relatively to each other.

The lock pin 24 extends upwardly between convolutions of an extension coil spring 25, the ends of which are connected to the flanges 15 and 16 of the bracket 13. The pin 24 is provided at its upper end with a head 26, which is urged downwardly by the spring 25 to thereby resiliently maintain the pin 24 in locking position as shown in FIGS. 3 and 4.

When it is desired to change the length of the device, the spring 25 is pulled upwardly to thereby release the pin 24 from the holes 11 and 12, after which the member 6 can be moved relatively to the member 1 and the pin 24 aligned with a new set of holes 11 and 12, and the spring released to thereby lock the members 6 and 1 in adjusted position.

In thus adjusting the length of the device, the fact that the bracket 13 is loosely mounted on the base 7 of the member 1 permits the bracket to be moved relatively to said base, so that the bracket, and thus the handle 23, can always be disposed midway of the length of the device, irrespective of the adjusted length of the device.

After the device has been adjusted to required length, a cloth 27 of generally rectangular configuration, and of a length in excess of the length of the adjusted length, is provided, as shown in FIGS. 1 to 5 inclusive, and the device is placed over said cloth.

Marginal portions of the cloth, as indicated at 27*a* and 27*b*, are folded over onto the members 6 and 1, and the ends of the cloth, as indicated at 27*c* are then folded over onto the marginal portions 27*a* and 27*b*.

Figure 5:
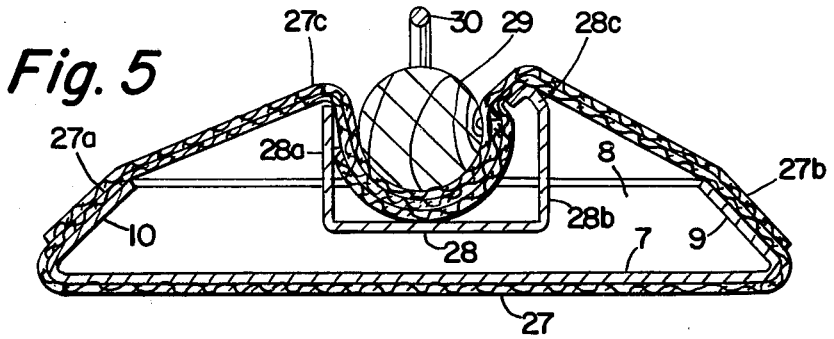
FIG. 5 is a fragmentary cross-sectional view, taken on the line 5—5 of FIG. 1.

For the purpose of maintaining the cloth 27 in the folded condition which has been described, means are provided, as best seen in FIGS. 1, 2 and 5.

Such means comprises channel members 28 having spaced upright flanges 28*a* and 28*b*, with the flanges 28*a* and 28*b* terminating at their upper ends in inturned flanges 28*c* of inverted V-shaped cross-section.

The members 28 are disposed as shown in FIG. 5, to overlie the base 7 and 2, but are not attached to such bases.

With the members 28 thus disposed, and the portions 27*a*, 27*b* and 27*c* of the cloth 27 in the folded condition shown, weights 29 are placed over the portions 27*c* of the cloth, in a position corresponding to the position of the members 28, such placement being facilitated by the provision of handles 30 attached to the weights 29. In such position, the weights 29 serve to maintain the portions 27*a*, 27*b* and 27*c* in the folded position shown.

The weights 29 may be solid metallic bars, as shown, or may be tubular metal bars. Moreover, they may be of circular cross-section or non-circular cross-section.

It may be noted, at this point, that the mere mass of the weights 29 is sufficient to maintain the cloth 27 in the folded condition shown, throughout any and all uses of the device.

However, under some conditions, it may be desirable to clamp the folded portions of the cloth 27 in the position shown. In that case, the weights 29 are made to have a diameter or outside dimension such that when the weights are pressed downwardly they cause the flanges 28*a* and 28*b* of the members 28 to spring apart slightly, thereby causing the weights to be snapped into position and held in such position. The handles 30, in such cases, facilitate removal of the weights from such position. In thus snapping the weights into position, the members 28 may be lifted off the bases 7 and 2, as indicated in FIG. 5.

The device, as thus described, may be used for various purposes, such, for example, as cleaning, dusting or wiping or polishing bowling lanes, or applying fluids such as liquid wax, to the lanes, or for other purposes.

Figure 6:
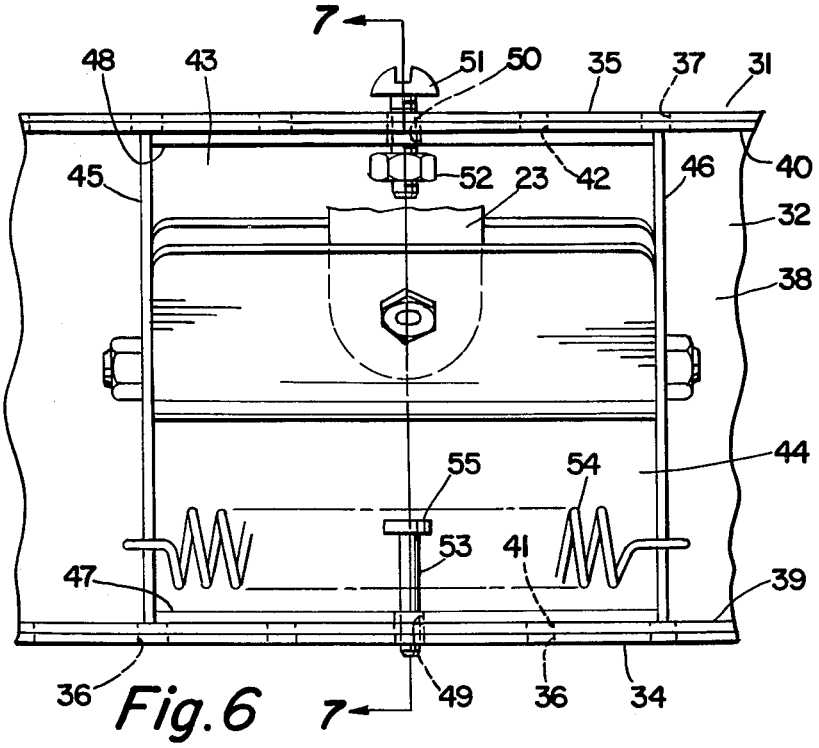
FIG. 6 is a view similar to FIG. 1, but showing a modification of the handle and tray attachment means.
Figure 7:
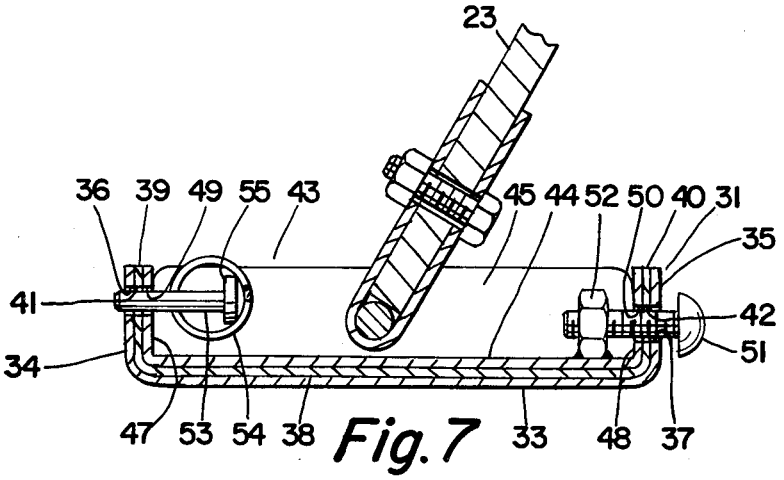
FIG. 7 is a fragmentary cross-sectional view, taken on the line 7—7 of FIG. 6.

In FIGS. 6 and 7 of the drawings, a modification of the device is shown.

In this modification, tray-like members 31 and 32 are provided, similar to the members 1 and 6 respectively.

The member 31 comprises a base 33 and upstanding spaced flanges 34 and 35. The flange 34 is provided with longitudinally-spaced holes 36, while the flange 35 is provided with longitudinally-spaced holes 37.

The member 32 comprises a base 38, and upstanding spaced flanges 39 and 40. The flange 39 is provided with holes 41 spaced to correspond with the spacing of the holes 36, while the flange 40 is provided with holes 42 spaced to correspond with the spacing of the holes 37.

Loosely mounted on the base 38 of the member 32 is a bracket, generally designated by reference numeral 43, and comprising a flat base 44, longitudinally-spaced flanges 45 and 46, and laterally-spaced flanges 47 and 48.

The flange 47 is provided at its mid-point with a hole 49, which serves a purpose to be presently described.

The flange 48 is provided at its mid-point with a hole 50, through which a screw 51 extends, and is threadedly secured to a nut 52, which is welded to the base 44 of the bracket 43.

A lock pin 53 is provided which extends into the hole 49 and into mating holes 41 and 36, for the purpose of maintaining the tray-like members 31 and 32 against longitudinal movement relatively to each other.

The lock pin 53 extends laterally of the device between convolutions of an extension coil spring 54, the ends of which are connected to the flanges 45 and 46 of the bracket 43. The pin 53 is provided at its rear end with a head 55, which is urged laterally by the spring 54 to thereby resiliently maintain the pin 53 in locking position.

When it is desired to change the length of the device, the screw 51 is removed, and the spring 54 is pulled rearwardly to thereby release the pin 53 from the holes 36 and 41, after which the member 32 can be moved relatively to the member 31, and the pin 53 aligned with a new set of holes 36 and 41, and the spring released to lock the members 31 and 32 in adjusted position.

In thus adjusting the length of the device, the fact that the bracket 43 is loosely mounted on the base 38 of the member 32 permits the bracket to be moved relatively to said base so that the bracket, and thus the handle 23, can always be disposed midway of the length of the device, irrespective of the adjusted length of the device. Following such centralization of the handle, the screw 51 is passed through mating holes 37 and 42, and the hole 50, and threaded into the nut 52, to lock the bracket 43 to the member 32.

Figure 8:
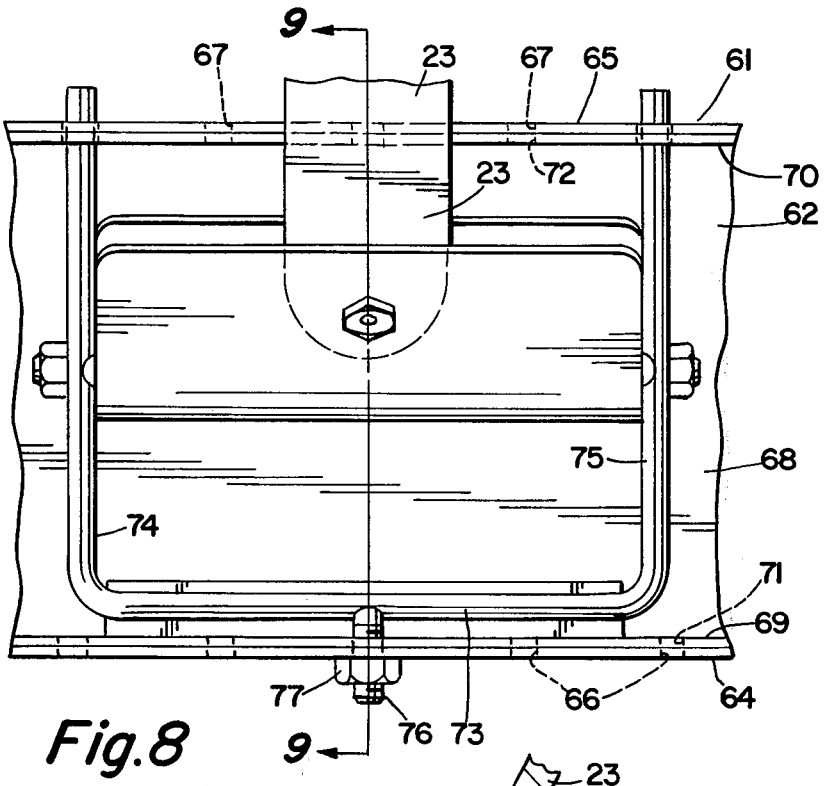
FIG. 8 is a view similar to FIG. 6, but showing another modification of the handle and tray attachment means.
Figure 9:
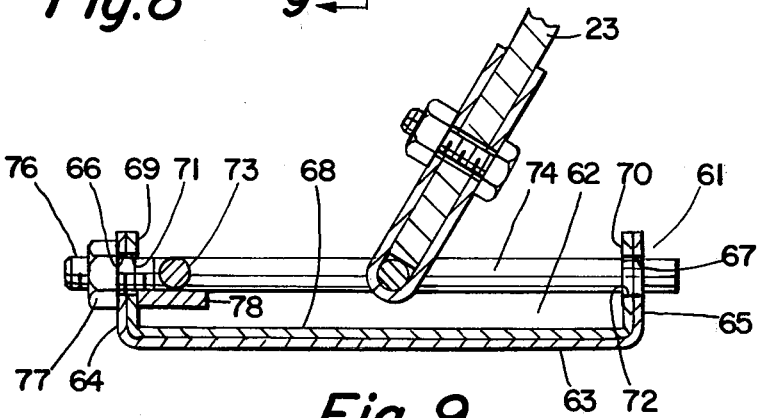
FIG. 9 is a fragmentary cross-sectional view, taken on the line 9—9 of FIG. 8.

In FIGS. 8 and 9, another modification of the device is shown.

In this modification, tray-like members 61 and 62 are provided, which are similar to the members 31 and 32 of FIG. 6 respectively.

The member 61 comprises a base 63 and upstanding spaced flanges 64 and 65. The flange 64 is provided with longitudinally-spaced holes 66, while the flange 65 is provided with longitudinally-spaced holes 67.

The member 62 comprises a base 68 and upstanding spaced flanges 69 and 70. The flange 69 is provided with holes 71 spaced to correspond with the spacing of holes 66, while the flange 70 is provided with holes 72 spaced to correspond with the spacing of the holes 67.

Instead of utilizing a bracket, such as the bracket 13 of FIG. 1, or the bracket 43 of FIG. 6, other means of connecting the handle 23 to the device, and for adjusting the members 61 and 62 relatively to each other and for locking such members in adjusted position are utilized.

As shown in FIGS. 8 and 9, a U-shaped member consisting of a base 73 and spaced arms 74 and 75 is provided, which is disposed in the space between the flanges 69 and 70.

The base 73 is provided midway of its length with a threaded stud 76, which extends through mating holes 66 and 71, and is secured to the flanges 64 and 69 by means of a nut 77. A plate 78 is welded to the underside of the base 73 and abuts the flange 69 to limit movement of said base toward said flange.

The arms 74 and 75 extend through mating holes 72 and 67 to lock the members 61 and 62 together.

When it is desired to change the length of the device, the nut 77 is removed from the stud 76, and the stud withdrawn from the holes 71 and 66. After such withdrawal, the member 73-74-75 is lifted slightly to bring the stud above the level of the flanges 69 and 64, after which the arms 74 and 75 are withdrawn from the holes 67 and 72. After this, the member 62 can be moved relatively to the member 61 to adjust the length of the device, and the locking means re-installed to lock the members in adjusted position.

Due to the provision of the multiple holes in the flanges of the members, the position of the handle 23 can be so adjusted, as to bring the handle to the center of the adjusted device, as in the previously described modifications.

In FIGS. 10, 11, 12 and 13, a modification of the device is shown, which may be described as follows:

The device comprises end plates 80 and 81. The end plate 80 has a base flange 82, and the end plate 81 has a base flange 83.

Secured to the base flanges 82 and 83 is a pair of laterally-spaced cloth retainers 84, which may be aluminum extrusions of a cross-section similar to that of the members 28 in FIG. 5.

Secured to the base of this device, as by means of rods or bars 85 and 86 (FIG. 11) is a cloth 87, the marginal portions of which are laid in the retainers 84, after which the rods or bars 85 or 86 are placed over such marginal portions and either clamp the cloth to the retainers 84 or, by their own weight, serve to secure the cloth to such retainers.

The cloth retainers 84 preferably have strips **84*a* of polyurethane or like resilient material adhesively secured to the lower faces thereof, to provide a soft backing for the cloth 87**.

Secured to the aforesaid device is a handle assembly, consisting of end members 88 and 89, a cross-member 90 interconnecting the upper ends of the members 88 and 89, and a handle 91 connected to the cross-member 90 at its mid-point.

The members 88 and 89 are connected to the end plates 80 and 81, at the lower mid-points thereof, by means of bolts 92 and nuts 93, and the handle 91 is rigidly connected to the cross-member 90 at the mid-point thereof.

Figure 12:
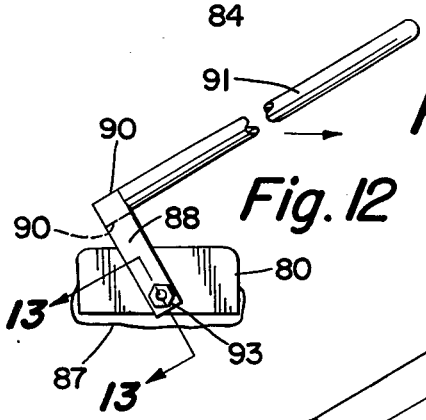
FIG. 12 is an end elevational view of the device of FIG. 10, as viewed from the right end of FIG. 10.
Figure 13:
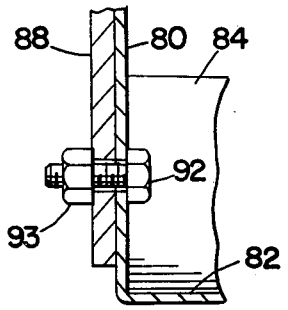
FIG. 13 is a fragmentary cross-sectional view, taken on the line 13—13 of FIG. 12.

It is to be noted that when the device is pulled along a floor by means of the handle 91, in the direction indicated by the arrow in FIG. 12, a downward pressure is applied to the device by the end members 88 and 89, which pressure tends to prevent the device from tipping or tilting, and, at the same time, serves to increase the downward pressure on the cloth 87. This pressure is at a maximum when the members 88 and 89 are to the left of the axes of the bolts 92, and when the handle 91 is, as shown, at an angle of 90° to a plane which contains both members 88 and 89.

When the device is pulled by persons of different heights, the elevation of the handle 91 may be adjusted by loosening the nuts 93, pivoting the members 88 and 89 about the bolts 92, adjusting the position of the members 88 and 89, and then tightening the nuts 93.

Figure 14:
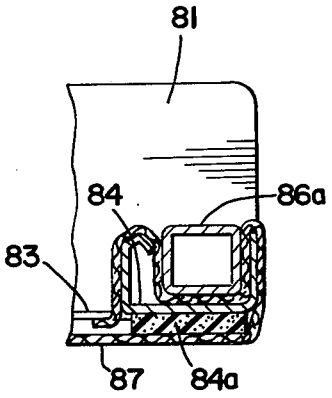
FIG. 14 is a fragmentary cross-sectional view, similar to the right end of FIG. 11, but showing a modification of the means for holding or clamping the cloth to the device.

In FIG. 14, a modification is shown, in which the bars **86*a***, instead of being of round cross-section, are of square or rectangular cross-section.

Figure 10:
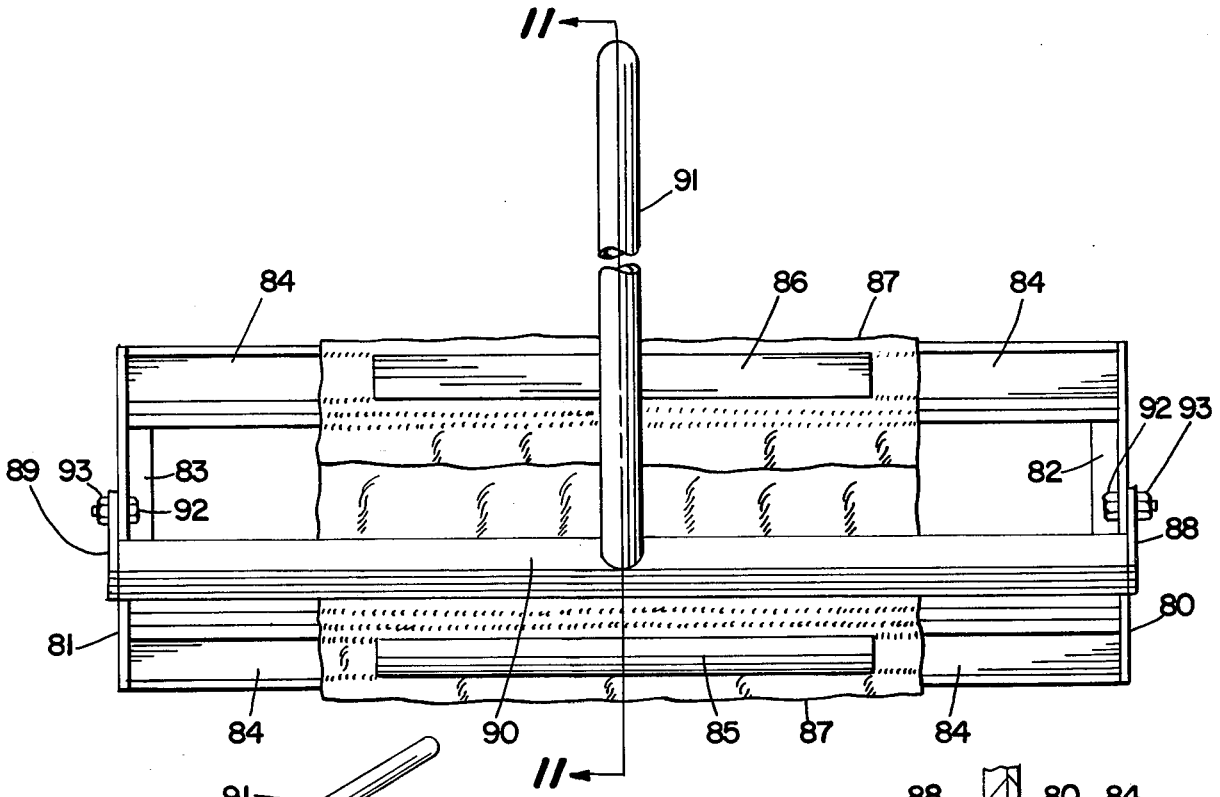
FIG. 10 is a top plan view similar to FIG. 1, but showing another modification of the invention.
Figure 15:
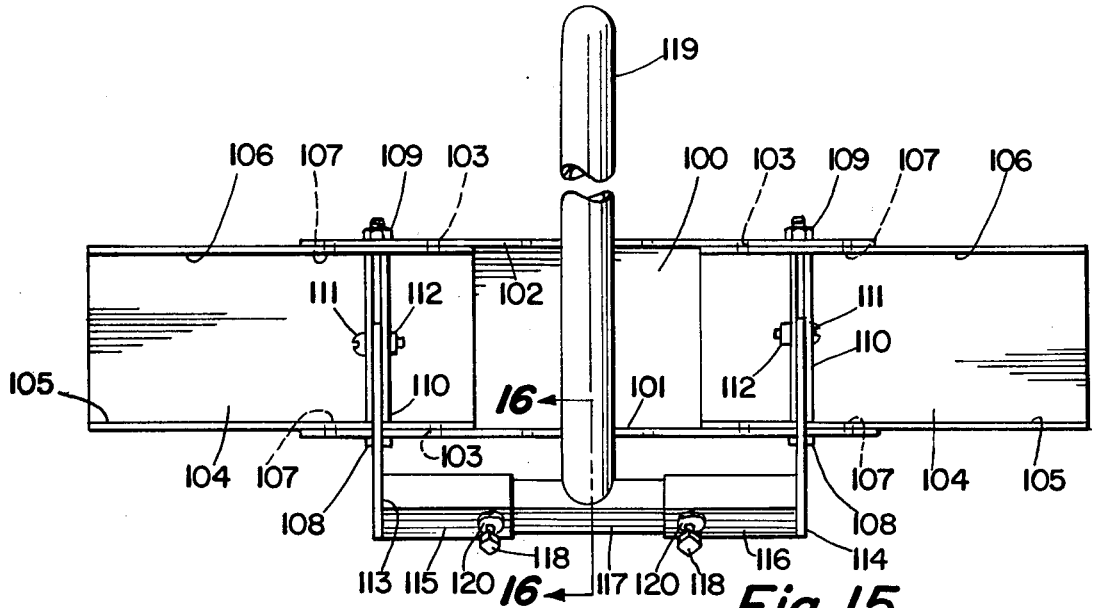
FIG. 15 is a top plan view similar to FIGS. 1 and 10, but showing another modification of the device.
Figure 16:
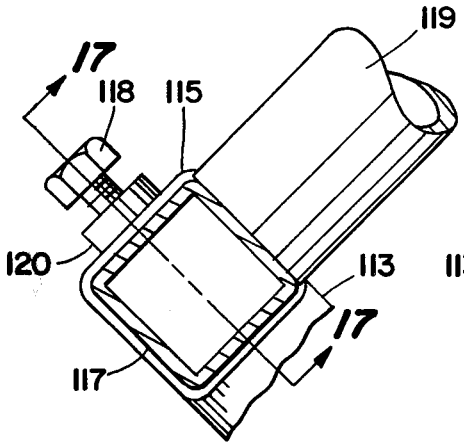
FIG. 16 is a fragmentary cross-sectional view, taken on the line 16—16 of FIG. 15.
Figure 17:
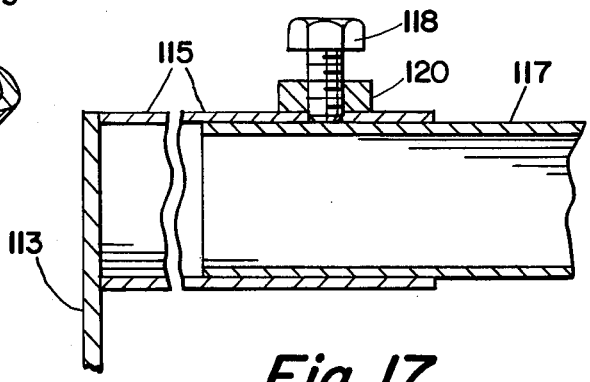
FIG. 17 is a fragmentary cross-sectional view, taken on the line 17—17 of FIG. 16.

In FIGS. 15, 16 and 17, a modification of the device shown in FIGS. 1 and 10 is illustrated.

In this modification, a tray is provided, comprising a base 100 and upstanding flanges 101 and 102, each provided with longitudinally-spaced holes 103.

For the purpose of extending the length of the device, a pair of extension trays are provided, each comprising a base 104 and upstanding flanges 105 and 106, these trays being mounted for slidable movement in the ends of the tray 100.

The flanges 105 and 106 are provided with holes 107, spaced to correspond with the spacing of the holes 103.

The extension trays are connected to the tray 100 by means of bolts 108 which extend through holes 107 and 103, and nuts 109 connected to the bolts 108.

Figure 11:
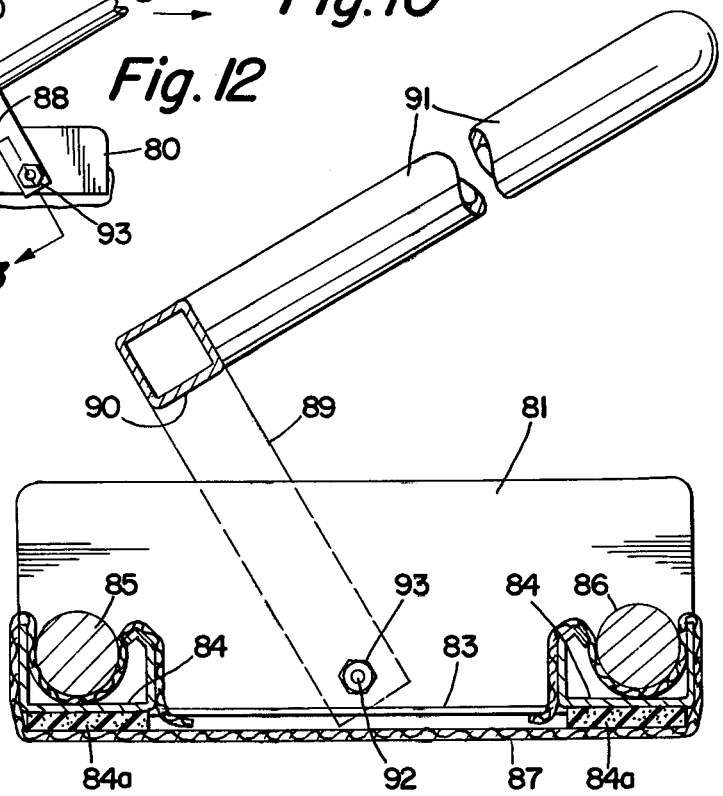
FIG. 11 is a cross-sectional view, taken on the line 11—11 of FIG. 10.

It will be understood that the trays 104 may be adjusted relatively to the trays 100 to alter the length of the device, to accommodate cloths of different lengths, after which a cloth (not shown), similar to the cloth 87 in FIG. 10, may be secured to the device in the manner shown in FIG. 1, FIG. 11, or in any other desired manner.

Secured to the bolts 108 are members 110, of U-shaped cross-section, similar to the members 20 in FIG. 3.

Secured to the members 110, by means of screws 111 and nuts 112, is a handle assembly consisting of end members 113 and 114, a cross-bar 115 extending at right angles to the member 113, a cross-bar 116 extending at right angles to the member 114, a cross-bar 117, the ends of which are telescopically mounted in the bars 115 and 116, and secured to the latter by means of set screws 118, and a handle 119 secured to the bar 117 at the mid-point of the latter. The set screws 118 are threadedly mounted in bosses 120, which are welded to the bars 115 and 116.

It will be understood that when the extension trays are adjusted, the set screws 118 are loosened, the bars 115 and 116 are moved relatively to each other, and to the bar 117, after which the set screws 118 are tightened to secure the bars 115 and 116 to the bar 117, in the adjusted position.

It will be noted that the angular relationship of the handle 119, cross-bars 115, 116 and 117, and the end members 113 and 114 of the handle assembly is the same as the corresponding parts of the handle assembly shown in FIGS. 10, 11, 12, 13 and 14, so that all of the advantages described above in connection with FIGS. 10–14 inclusive are obtained in the modification of FIGS. 15, 16 and 17.

Moreover, by loosening the nuts 112, the working angle or elevation of the handle 119 may be adjusted for users of different heights.

Figure 18:
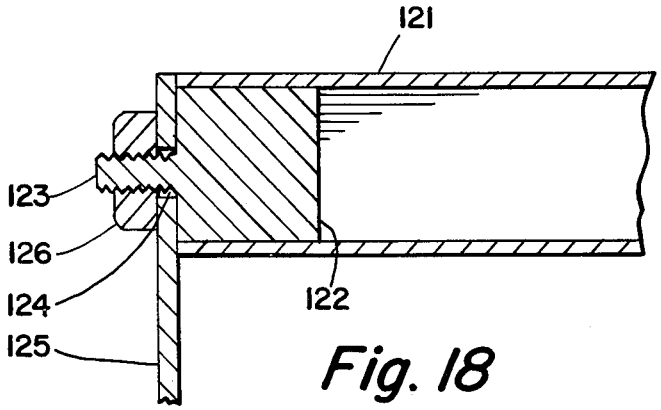
FIG. 18 is a view similar to FIG. 17, but showing a modification of the device of FIGS. 15, 16 and 17.

In FIG. 18, a modification is shown, in which the outboard ends of the members 121 (corresponding to the members 115 and 116) have rigidly mount d therein blocks 122 having a threaded pin 123 extending therefrom.

The pin 123 extends through a hole 124 in the end member 125 (corresponding to the member 113), and is secured to the member 125 by a nut 126. By providing the member 125 with a series of longitudinally-spaced holes, the position of the cross-bars longitudinally of the members 125 may be adjusted to thereby adjust the position of the handle 119 relatively to the device.

Figure 19:
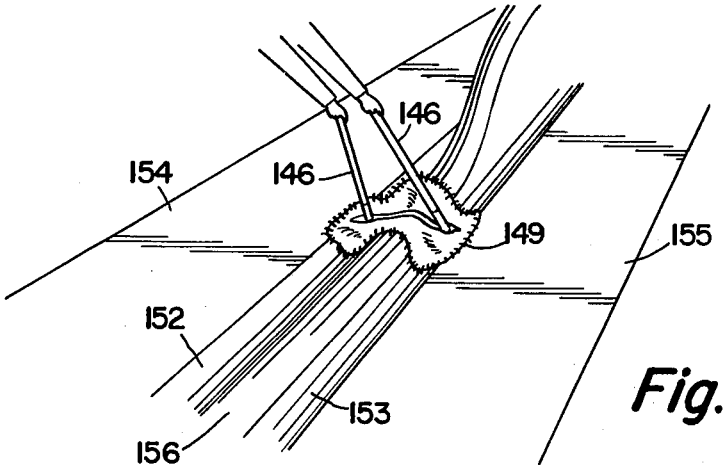
FIG. 19 is a fragmentary perspective view showing a device which is especially adapted for simultaneously cleaning the gutters of adjacent bowling lanes, and the area between such gutters.
Figure 20:
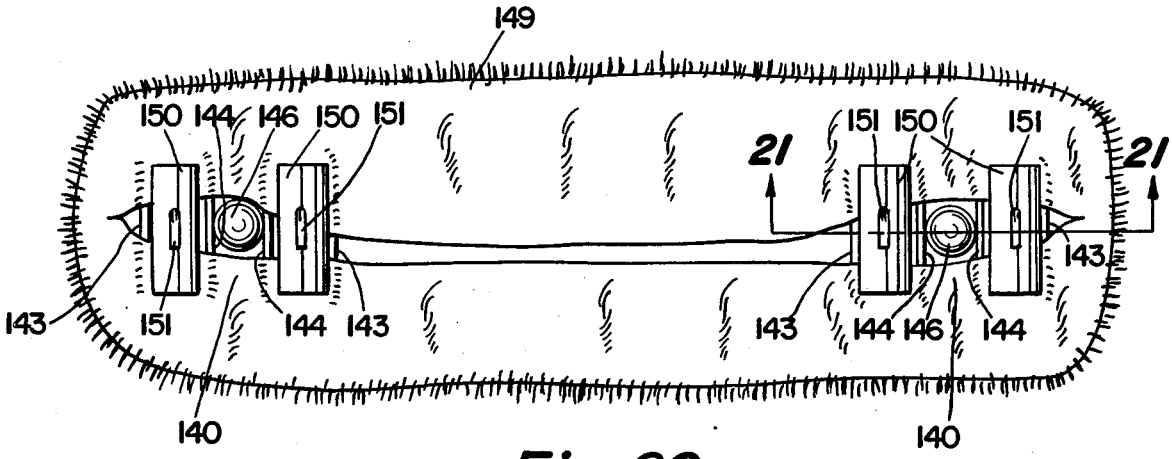
FIG. 20 is a plan view of the device of FIG. 19.
Figure 21:
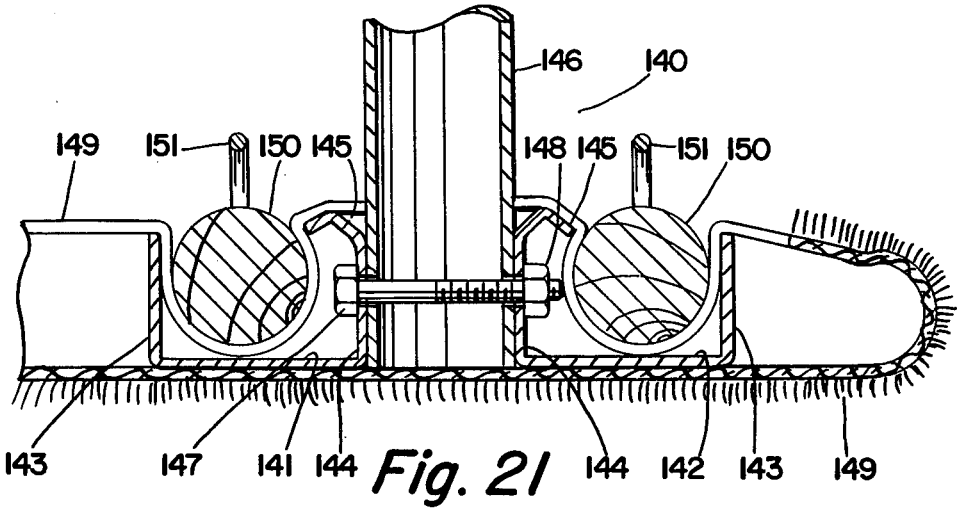
FIG. 21 is a fragmentary cross-sectional view, taken on the line 21—21 of FIG. 20.

In FIGS. 19, 20 and 21, a modification of the device is shown, which is especially adapted for simultaneously cleaning the gutters of adjacent bowling lanes, and the area or cap between such gutters.

The device comprises two spaced devices, each being designated generally by reference numeral 140.

Each device 140 comprises a pair of channel-shaped members 141 and 142, which are parallel with each other, and has upstanding flanges 143 and 144, the flanges 144 terminating in inwardly-extending flanges 145 of inverted V-shaped cross-section.

The flanges 144 of the members 141 and 142 are in spaced back-to-back relation, as best seen in FIG. 21, and have disposed therebetween a handle 146, which extends into the space between the flanges 144 and is pivotally connected to a bolt 147, which extends through these flanges and the handle 146, and is secured in place by a nut 148.

A cleaning or dusting cloth 149 is placed about the spaced pair of unconnected devices 140 in the manner shown in FIGS. 19, 20 and 21, and weights 150, consisting of short round bars are placed over the cloth 149, so that these weights press portions of the cloth into the channel members 141 and 142 in the manner shown in FIG. 21, to thereby secure the cloth to the devices 140.

The weights 150 are provided with handles 151 to aid in placement of the weights and removal of the weights, when the cloth is to be cleaned or replaced.

The devices are utilized in the manner shown in FIG. 19, for simultaneously cleaning the gutters 152 and 153 of adjacent bowling lanes 154 and 155, and the area or cap 156 between said gutters.

By making the bars 150 of sufficient diameter, the bars may be resiliently snapped into the members 141 and 142, to thereby more firmly hold the cloth 149 in clamped position.

It will be understood that certain features of the various examples and modifications which have been described may be incorporated in other examples or modifications.

It is to be understood that the forms of my invention herewith shown and described, are to be taken as preferred examples of the same, and that various changes may be made in the shape, size and arrangement of parts thereof, without departing from the spirit of the invention or the scope of the subjoined claims.

Having thus described my invention, I claim:

1. A device of the character described comprising a pair of longitudinally-spaced end plates, a pair of laterally-spaced cloth-retaining members interconnecting said end plates, said cloth-retaining members comprising channel shaped members consisting of a base and upstanding spaced flanges resiliently movable relatively to each other, a handle assembly removably connected to said end plates, a cloth supported by said cloth-retaining members, and means for securing portions of said cloth to said cloth-retaining members, said cloth adapted to apply a fluid to a surface upon which the cloth comes into contact.

2. A device as defined in claim 1, wherein said handle assembly comprises end members secured to said end plates, a cross-bar interconnecting said end plates and a handle connected to said cross-bar at substantially the mid-point of its length.

3. In a device of the character described, a support of generally rectangular configuration, a cloth disposed beneath said support and having marginal portions clamped to said support adjacent the longitudinal edges thereof, said device adapted to be pulled in a predetermined direction along a floor, arms removably secured to said device at points midway of the shorter edges of said device and extending in a direction generally opposite to the direction in which said device is to be pulled and lying in a common plane at an acute angle to the plane of said support, a cross-bar interconnecting the upper ends of said arms, a handle extending in the general direction in which said device is to be pulled and connected to said cross-bar at substantially the midpoint of its length, said handle disposed at an angle not greater than 90 degrees to said common plane and means secured to said device adjacent said longitudinal edges for clamping said marginal portions of said cloth to said longitudinal edges said clamping means comprising channel-shaped members, each consisting of a base and upstanding spaced flange resiliently movable relatively to each other.

4. In a device of the character described, a support of generally rectangular configuration comprising longitudinally-spaced upright end plates, each having a base flange, laterally-spaced cloth retainers secured to said base flanges and extending between said upright end plates, said support disposed in a generally horizontal plane and adapted to be pulled along a floor in a direction substantially perpendicular to the length of said cloth retainers, a cloth underlying said support and having marginal portions secured to said cloth retainers, a handle assembly for pulling said support in said direction, said handle assembly comprising arms secured to said end plates at points midway of the length of said end plates and closely adjacent the lower edges of said end plates and extending in a direction generally opposite to the direction in which said support is adapted to be pulled and lying in a common plane disposed at an acute angle to the plane of said support, a cross-bar interconnecting the upper ends of said arms, and a handle extending in the general direction in which said support is adapted to be pulled and connected to said cross-bar at substantially the midpoint of its length, said handle disposed at an angle of not greater than 90 degrees to said common plane, whereby when said device is pulled along a floor, pressure of said handle on said arms is effective to prevent said device from tipping or tilting and, at the same time, to increase the downward pressure of said cloth against said floor.

5. A device as defined in claim 4, including means for securing said marginal portions of said cloth to said cloth retainers.

* * * * *